US008408954B2

(12) United States Patent
Sturm

(10) Patent No.: US 8,408,954 B2
(45) **Date of Patent: *Apr. 2, 2013**

(54) WATERCRAFT FOR TRANSPORTATION AND EXERCISE

(76) Inventor: Rex L. Sturm, Sharpsburg, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/424,760

(22) Filed: Mar. 20, 2012

(65) Prior Publication Data

US 2012/0190254 A1 Jul. 26, 2012

Related U.S. Application Data

(63) Continuation of application No. 11/753,204, filed on May 24, 2007, now Pat. No. 8,167,667.

(51) Int. Cl.
*B63H 16/00* (2006.01)

(52) U.S. Cl. ..... 440/21; 440/32

(58) Field of Classification Search ..... 440/21, 440/32

See application file for complete search history.

(56) References Cited

U.S. PATENT DOCUMENTS

| | | | |
|---|---|---|---|
| 3,987,747 | A | 10/1976 | Locher |
| 4,092,945 | A | 6/1978 | Ankert |
| 4,172,427 | A | 10/1979 | Kindred |
| 4,559,892 | A | 12/1985 | Cascallana |
| 4,631,037 | A | 12/1986 | Dickens |
| 4,700,648 | A | 10/1987 | Trefethern |
| 4,789,365 | A | 12/1988 | Jones |
| 4,938,722 | A | 7/1990 | Rizley |
| 4,973,278 | A | 11/1990 | Williams |
| 5,081,947 | A | 1/1992 | Holden |
| 5,088,944 | A | 2/1992 | Kats |
| 5,090,928 | A | 2/1992 | Rybczyk |
| 5,135,448 | A | 8/1992 | Dunn |
| 5,217,400 | A | 6/1993 | Creek |
| 5,362,264 | A | 11/1994 | Parant |
| 5,509,831 | A | 4/1996 | Gelbart |
| 5,601,461 | A | 2/1997 | Mills |
| 5,651,706 | A | 7/1997 | Kasper |

(Continued)

FOREIGN PATENT DOCUMENTS

| | | |
|---|---|---|
| KR | 20-0427841 | 9/2006 |
| KR | 10-2007-0011683 | 1/2007 |

OTHER PUBLICATIONS 2 pages of a SEA EAGLE 325fc FoldCat from an Internet website , Mar. 2007.

3 pages showing an Aquatic Therapy Bike and Underwater Bike from an internet website , Dec. 2003.

*Primary Examiner* — Stephen Avila
(74) *Attorney, Agent, or Firm* — Sturm & Fix LLP

(57) ABSTRACT

A watercraft for transportation and exercise including a boat having an opening therein for permitting a person to be partially below the waterline and partially above the waterline. A sub-frame is operatively attached to the boat, the sub-frame having a lower position and an upper position. A propulsion device is operatively attached to the sub-frame for propelling the watercraft forwardly in response to movement of the person's feet, the propulsion device having a foot contact portion. The foot contact portion of the propulsion device being disposed a predetermined distance from the waterline when using the propulsion device in the transportation mode, the foot contact portion of the propulsion device being disposed in the water and a substantial distance below the predetermined distance when the propulsion device is being used in an exercise mode.

17 Claims, 9 Drawing Sheets

U.S. PATENT DOCUMENTS 5,692,450 A 12/1997 Alter
5,692,932 A 12/1997 Lance
5,718,611 A 2/1998 Schlangen
5,722,865 A 3/1998 Tatum
5,803,774 A * 9/1998 White ..... 440/12
5,845,593 A 12/1998 Birkestrand
5,860,378 A 1/1999 Schaller
5,868,649 A 2/1999 Erickson
6,135,835 A 10/2000 Lekhtman
6,309,263 B1 10/2001 Mier-Maza
6,383,121 B1 5/2002 Galasso
6,457,430 B1 10/2002 Drabkin
6,490,989 B1 12/2002 Ray
6,500,034 B1 12/2002 Lau
6,595,813 B1 7/2003 Lekhtman
6,691,633 B1 2/2004 Metzger
6,855,016 B1 2/2005 Jansen
6,869,323 B2 3/2005 Norman
6,929,521 B2 8/2005 Howerton
8,167,667 B2 * 5/2012 Sturm ..... 440/21

* cited by examiner

WATERCRAFT FOR TRANSPORTATION AND EXERCISE

CROSS REFERENCE TO RELATED APPLICATIONS

This application is a continuation of U.S. Ser. No. 11/753,204 filed May 24, 2007, and entitled A WATERCRAFT FOR TRANSPORTATION AND EXERCISE, now U.S. Pat. No. 8,167,667 issued May 1, 2012, and is hereby incorporated by reference herein in its entirety.

FIELD OF THE INVENTION

The present invention relates generally to a watercraft for use as transportation and for exercise.

BACKGROUND OF THE INVENTION

Boats have been used for centuries and for many purposes. Of course the basic purpose of a boat is to allow people to be on top of a body of water and to go where they want to go. Sometimes this movement in a boat is for the sheer pleasure of boating. At other times it is to facilitate other activities, such traveling to a desired destination, pleasure or commercial fishing or transporting goods from one location to another.

Some boats, such a paddle boats, are typically used for short distances and are propelled using the feet of the passengers similar to the way that a bicycle is propelled from place to place. These paddle boats are typically perceived by those who use them as a way to enjoy the water while getting exercise at the same time.

The benefits of excising in water as compared to exercising outside of water have long been recognized. For example swimming is much easier on the joints, tendons, ligaments, etc. than jogging because the constant pounding of jogging is replaced by the resistance of the water. The limbs move slowly against the resistance of the water, but the resistance of the water causes the body to burn calories from fatty tissues and strengthens muscles due to the use thereof. But swimming in a body of water where boats abound is perilous for obvious reasons. Also, sometimes a person may want to swim a substantial distance from shore, but there are dangers in swimming to far from shore, for example a case of unexpected exhaustion that could put a person's life in danger. But, sometimes people just prefer to be in the water rather than on a boat.

There may be a segment of the population that if possible would desire to combine boating and exercising in the water. Currently those people are limited to traveling some place on a boat and then getting into the water to swim or water ski or the like. Accordingly, there is a need to have a device which can more easily combine the activities of boating and exercising.

SUMMARY

The present invention relates to a watercraft for transportation and exercise including a boat for floating on water and having a portion thereof above a waterline and a portion thereof below the waterline. An opening is disposed in the boat for permitting a person to be partially below the waterline and partially above the waterline. A propulsion device is attached to the boat and at least a portion thereof is disposed a predetermined distance below the waterline for propelling the watercraft forwardly in response to movement of the person's feet. A lower portion of the propulsion device is disposed a predetermined distance from the waterline in a transportation mode so that that person's buttocks is above the waterline when using the propulsion device in the transportation mode, the lower portion of the propulsion device being disposed a substantial distance below the predetermined distance when the propulsion device is being used in an exercise mode wherein the person's buttocks is preferably disposed below the waterline thereby creating more resistance to movement in the water as the person's legs are moved.

DETAILED DESCRIPTION OF THE PREFERRED EMBODIMENTS

Figure 1:
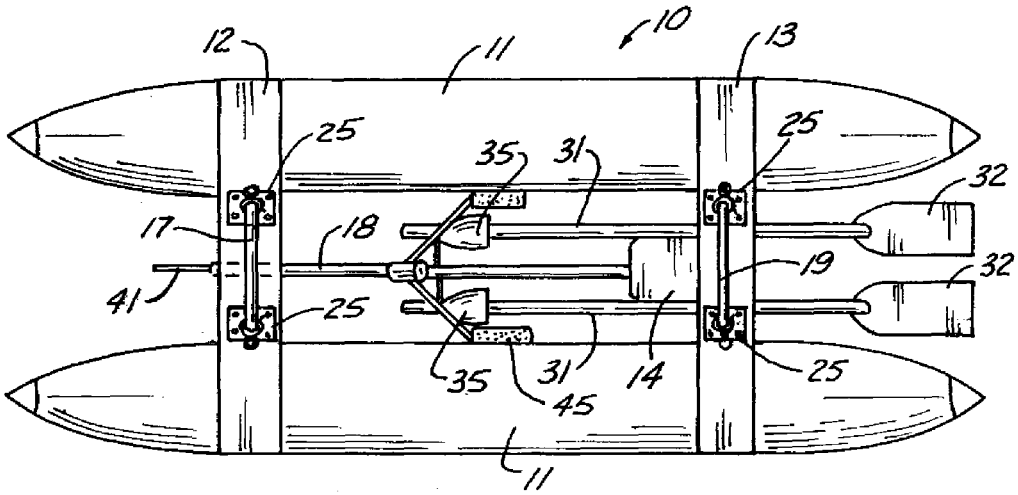
FIG. 1 is a top elevational view of a preferred embodiment of the present invention.

Referring now to the drawings wherein like reference numerals designate identical or similar parts throughout the several views, a preferred embodiment 10 of the present invention is illustrated in FIG. 1. The catamaran type boat 10 shown in FIG. 1 can, for example, be like the basic boat of U.S. Pat. No. 6,691,633, which patent is incorporated herein by reference in its entirety. It is to be understood however that this watercraft 10 can be of other types, more like a regular boat, for example as shown in U.S. Pat. No. 6,869,323 to Norman.

In the preferred embodiment of FIGS. 1-7, pontoons 11, which can be made of inflatable flexible material or made of other solid materials such as aluminum or plastic for example, are attached together at the front by a front brace member 12 and at the back by rear brace member 13.

An optional seat 14 and a propulsion device 16 are attached to a frame made of members 18-20. The frame portion 17 is a U-shaped member with holes 17*a* disposed in one or both sides of each vertical part of the U-shaped member 17. Similarly, the frame portion 19 is a U-shaped member with holes 19*a* disposed in one or both sides of each vertical part of the U-shaped member 19 for receiving a locking pin 28 for locking the U-shaped member 19 in any one of many selectable positions between the transportation position shown in FIGS. 2 and 5 and the exercise position shown in FIGS. 3 and 4. When this adjustment is made a similar adjustment and locking is desired for the frame portion 17 with U-shaped member with holes 17*a*. In other words, the adjusting and pinning of the U-shaped members 17 and 19 would typically occur sequentially and respectively front and back.

Figure 6:
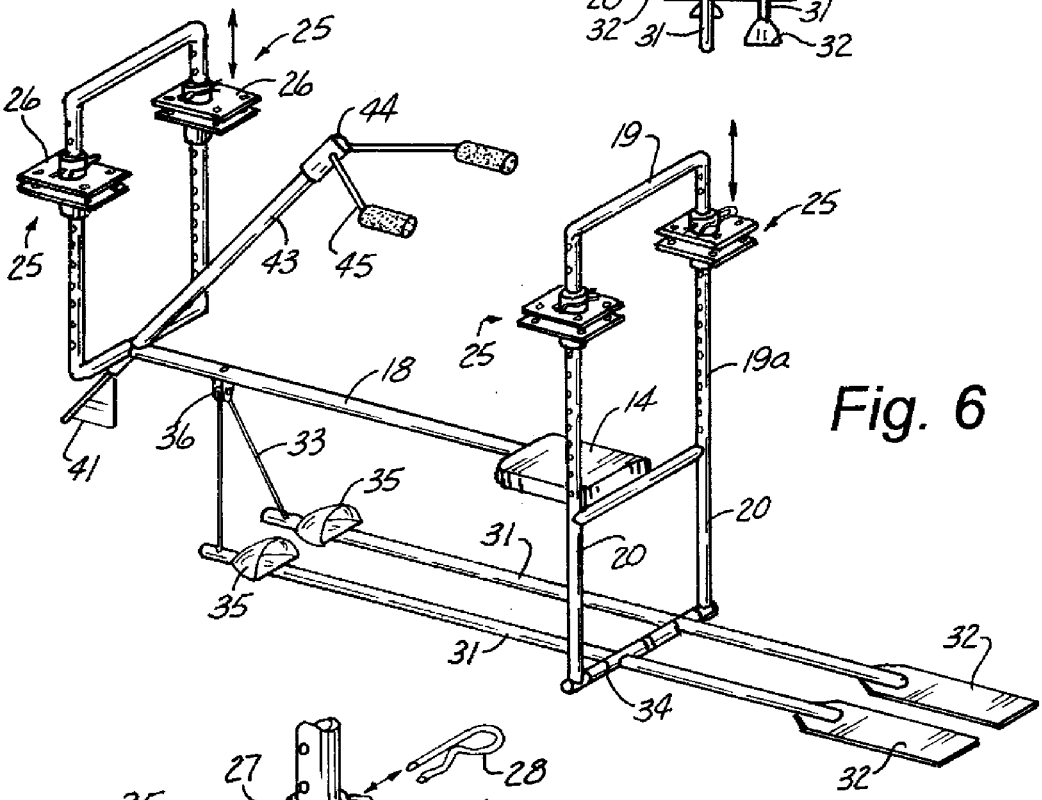
FIG. 6 is an enlarged perspective view of the structure of the present invention not attached to the pontoons to show the adjustable nature of the propulsion device, the seat and steering control.
Figure 7:
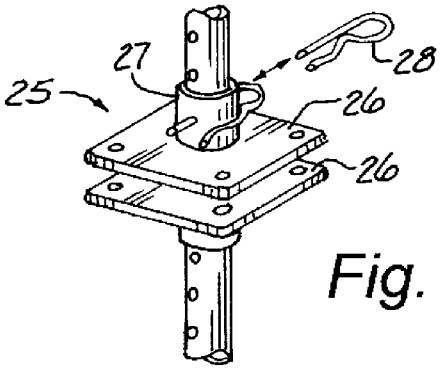
FIG. 7 is an enlarged perspective view of the of one of the four brackets shown if FIG. 6 to show how the vertical adjustments are made and how the locking device works.

Looking to FIGS. 6 and 7, it is noted that two brackets 25 are attached to the front brace member 12 and two brackets 25 are attached to the rear brace members 13. These brackets 25 are made of two plates 26, having an upwardly or downwardly cylindrical portion 27 thereon. These parts 26 and 27 are easily made as identical pieces, with of the units 26/27 up side down compared to the other unit 26/27 to make the basic bracket 25. Pins 28 are used to extend through a pair of aligned holes in members 27 of the top bracket 25 and through a selected one of the holes 17*a* or 19*a* of members 17 and 19 respectively.

The propulsion device 16 in the preferred embodiment has a pair of paddles 31, similar in shape to oars, having flat wide portions 32 on the rear end thereof, which can be solid like an oar or be flexible like swimming fins that people wear on their feet. These paddles 31 are pivotally attached at pivotal joint 34 to the frame member 20. The front end of the paddles 31 are attached to a flexible line 33, such as a cable, at each end of the cable 33. The cable 33 is threaded through a pulley 36, so that when a person, shown in dashed lines as 40 in the drawings, pushes down on one leg, the respective front end of that paddle 31 goes down because the person has that foot in foot holder 35, which causes the front end of the other paddle 31 to be pulled upwardly due to the forces transmitted through the cable 33. So the user would sequentially push down one leg and then the other, repeating this sequence as many times as desired, for moving the watercraft 10 forwardly. At the same time the person 40, can steer the watercraft 10 by turning the rudder 41 using the handlebars 45, which will turn a rod 42, inside of tube 43, which tube 43 is rigidly affixed to the frame members 18-20 approximately at the juncture of members 17 and 18. The steering mechanism of elements 41-45 moves up and down with the frame members 17-20, the propulsion system 16 and the optional seat 14.

It is to be understood that the propulsion system 16 can be of other types such as that shown in U.S. Pat. No. 6,691,633 to Metzger et al. or U.S. Pat. No. 6,869,323 to Norman, both of which are incorporated herein by reference in their entirety.

Figure 2:
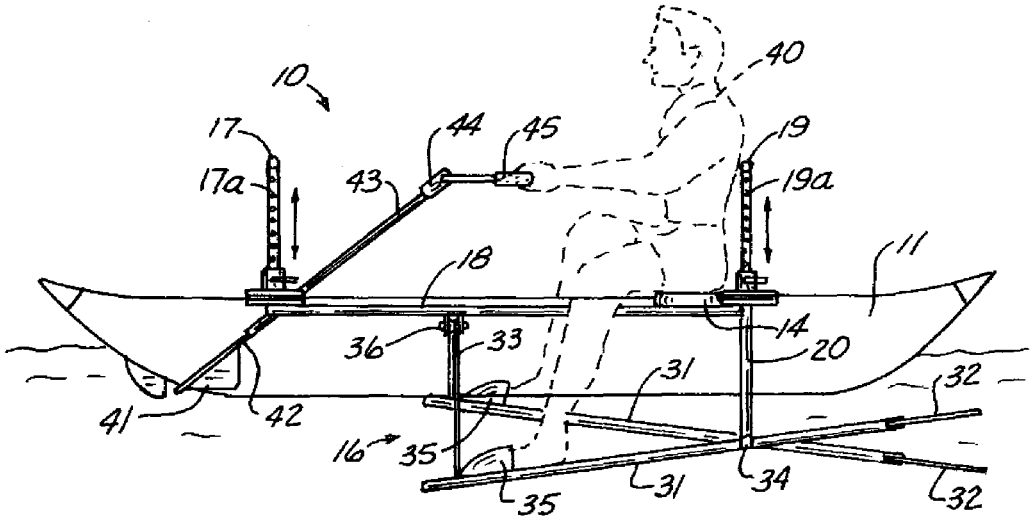
FIG. 2 is a side elevational view of the present invention in use in a position for moving forwardly as quickly as possible using only the energy from the person shown in dashed lines.
Figure 3:
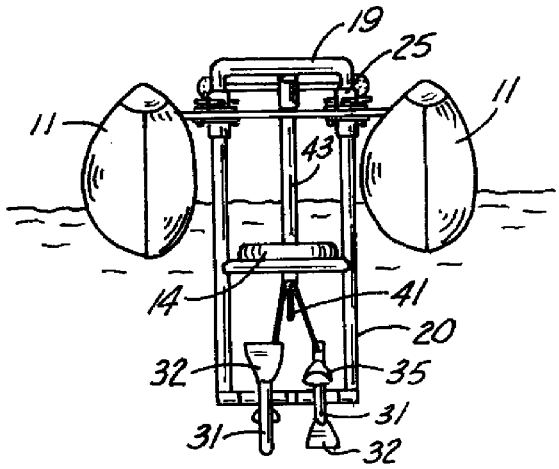
FIG. 3 is a rear elevational view shown in the water with the seat disposed downwardly in the water in the exercise mode shown in FIG. 4.
Figure 4:
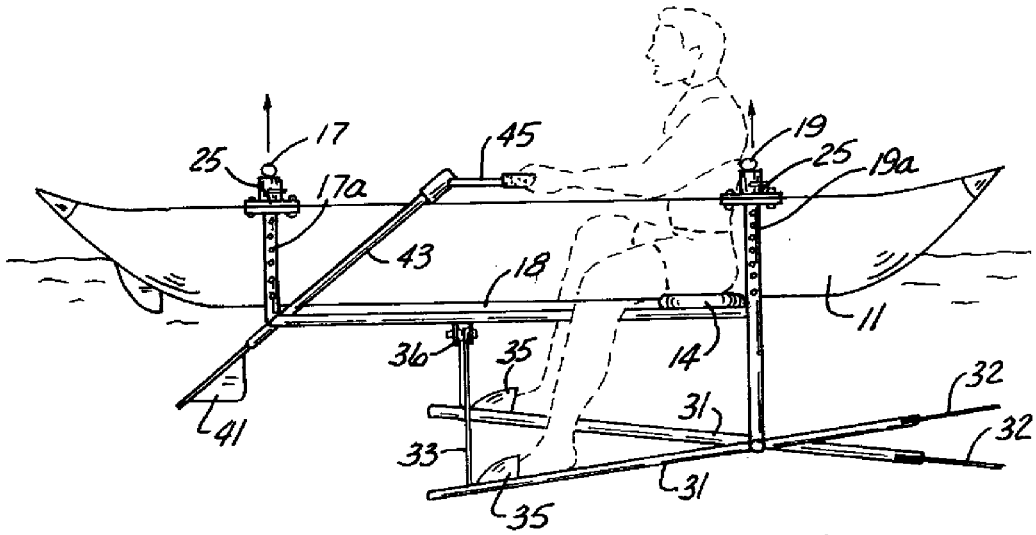
FIG. 4 is a side elevational view of the present invention in use in the position shown in FIG. 3 for moving forwardly using only the energy from the person shown in dashed lines, this position being used when it is desired to be in the mostly exercise mode.
Figure 5:
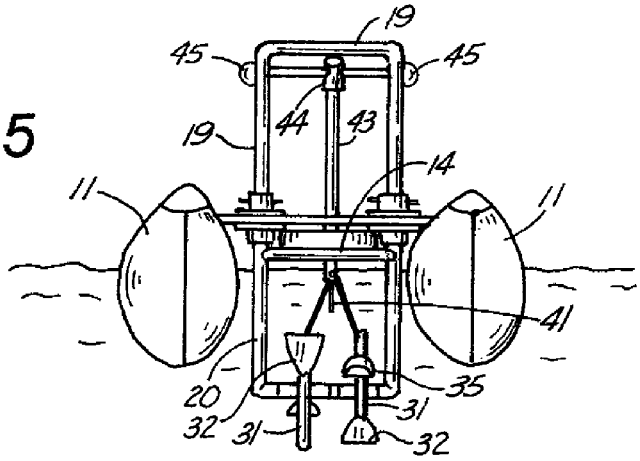
FIG. 5 is a rear elevational view shown in the water with the seat disposed upwardly out of the water in the manual fastest transportation mode shown in FIG. 2.

In operation of the embodiment of FIGS. 1-7, the operator 40 would typically use the watercraft 10 in the position shown in FIGS. 2 and 5 with the seat 14 out of the water so that only the user's legs are under the water. This will cause some drag on moving the watercraft forward. This invention is broad enough however, to work with the entire person's body above the water during the transportation mode similar to that shown in the two U.S. patents mentioned above, and then moving the framework that supports the steering mechanism, the person and the optional seat downwardly when it is desired to use the invention in an exercise mode. While the present invention shows the propulsion mechanism 16 moving up and down with the person 40, the seat 14 and the steering mechanism, it is contemplated that the propulsion device, if like that shown in the two patents mentioned above for example, could remain at the same vertical level and only the part of the propulsion device that contacts the person's legs 40 would move up or down with respect to the waterline as the handle bars, steering wheel and optional seat 14 are adjusted up or down.

So the person 40 may wish to travel a desired distance from shore and upon reaching a destination, pull the pins 28 from openings 17*a* and 19*a* and move the frame 17-20 from the position shown in FIGS. 2 and 5 to the exercise position shown in FIGS. 3 and 4. Then, when it is desired to go back to shore, a reverse adjustment is made so that it will be easy to propel the watercraft 10 back to the shore with minimal body resistance.

Figure 8:
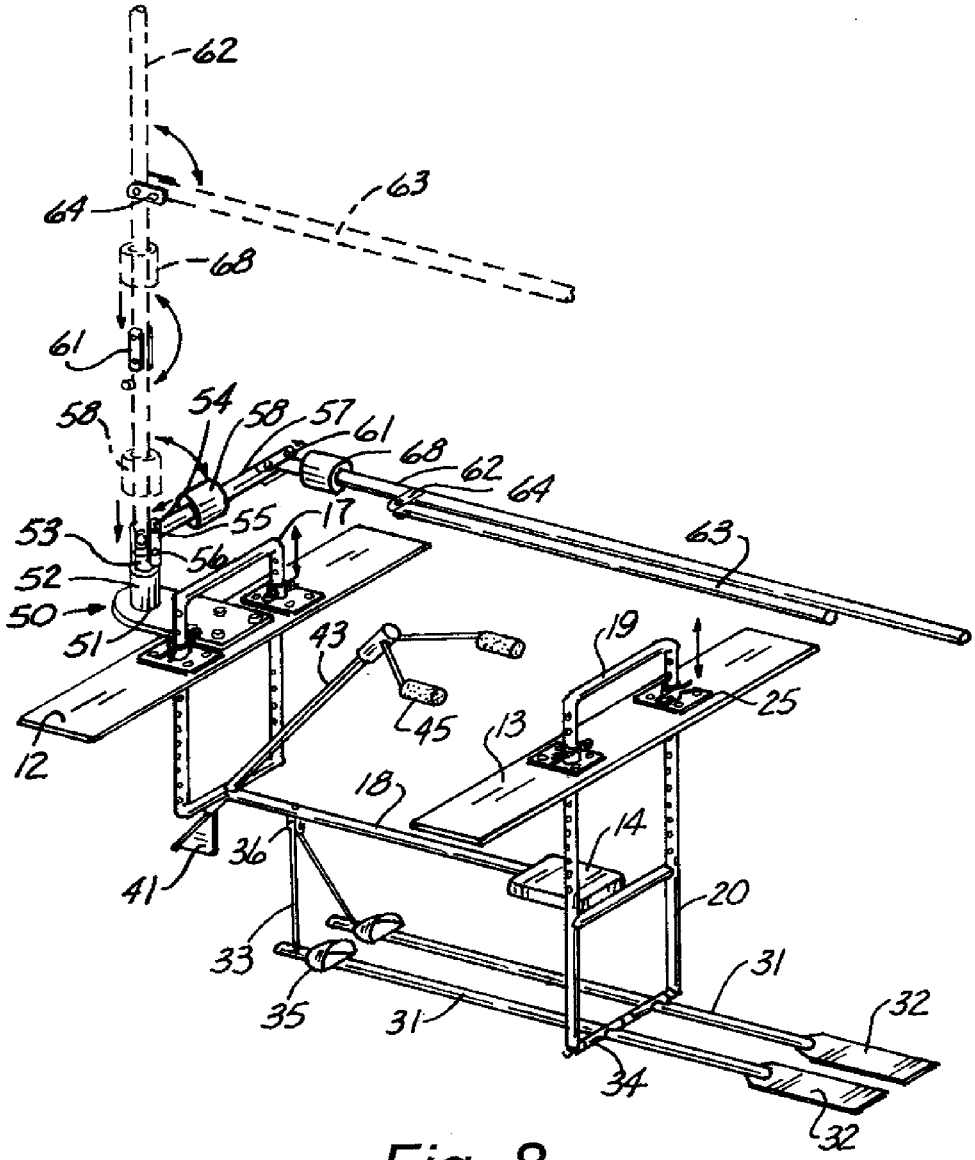
FIG. 8 is an enlarged perspective view like FIG. 7, but having an optional sailing mast attached thereto, in a stored position in solid lines and in dashed lines in an operative position thereof.
Figure 9:
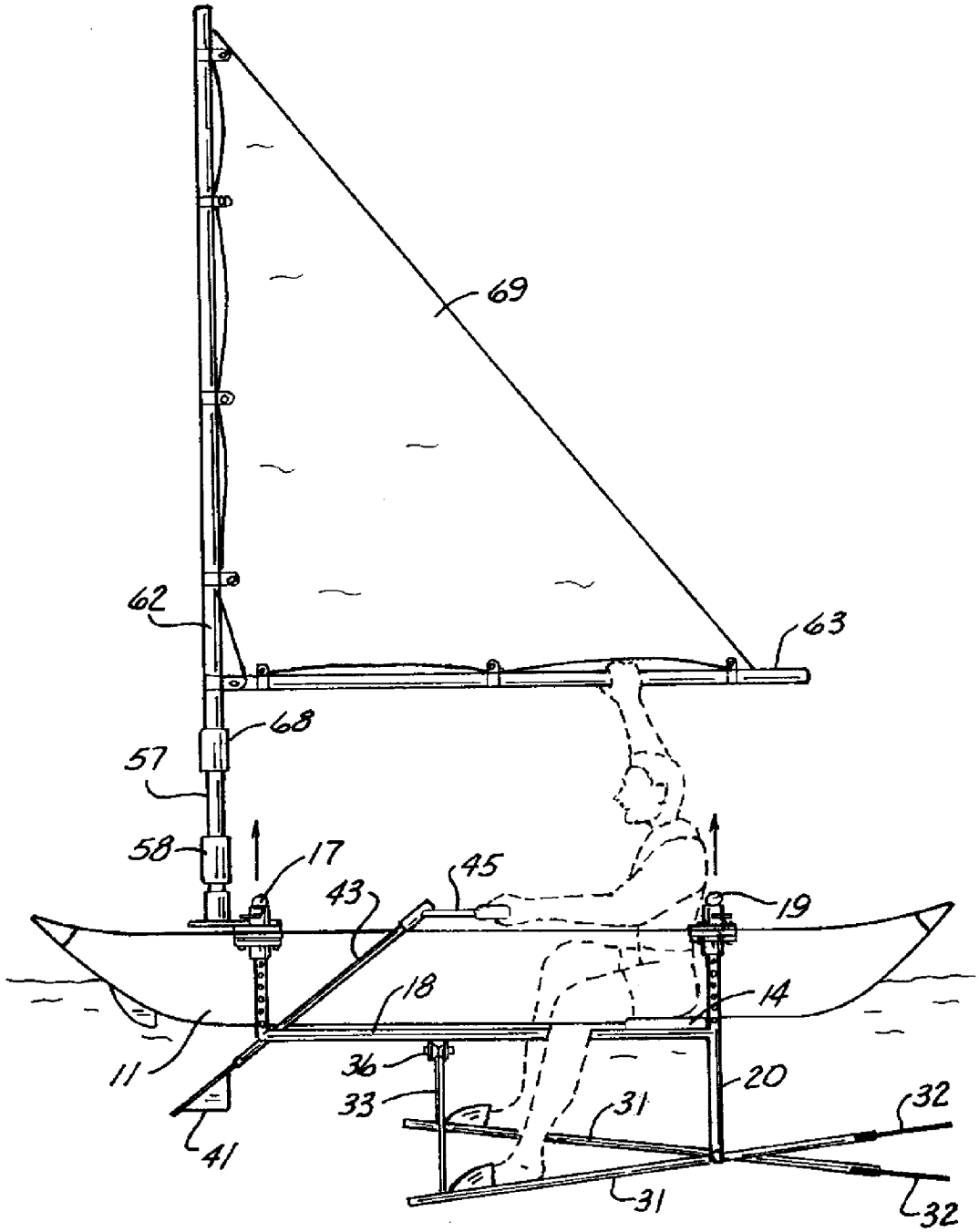
FIG. 9 is a view of a person using the watercraft in its sail boat mode.
Figure 10:
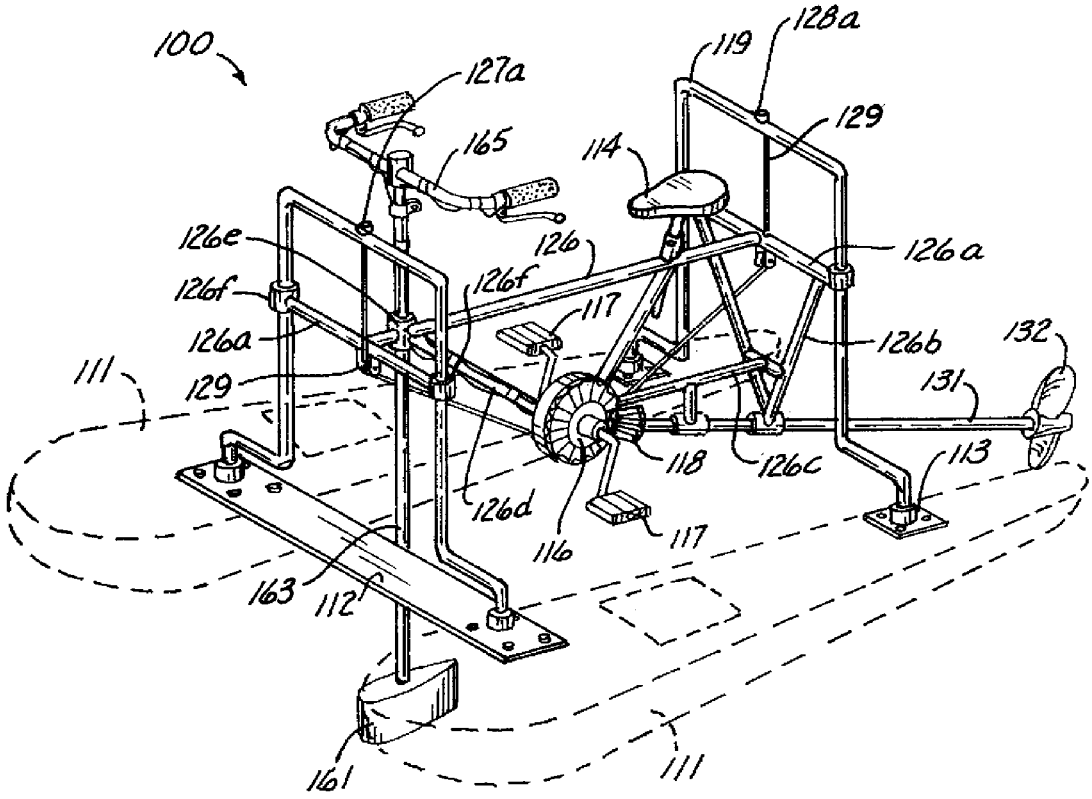
FIG. 10 is a perspective view of another embodiment of the present invention.

Another alternative way to power the watercraft is with an optional internal combustion engine, not shown, or with an optional sailing mast 50 as shown in FIG. 8. The optional mast 50, has a bracket 51 bolted to the front bracket 12. A cylindrical member 53 with a pin 53 has a universal connector with pin 55 and 56 extending through plates 54, allowing a mast pole 57 to selectively pivot about pin 55 when a collar 58 is not covering the joint as shown in solid lines in FIG. 8. another similar universal joint 61 with locking collar 68 allows the mast 50 to be folded as shown in FIG. 8 so that the member 62 with member 63 pivotally attached at joint 64 on it can be selectively moved and locked between solid line and dashed line positions shown in FIG. 8. The actual sail 69 attached to the mast 50 is shown in use in FIG. 9. When the sail is in use, the seat, propulsion system and steering system could also be in the upper, transport position if desired, though it is shown in the lowered exercise position in FIG. 9.

Referring now to the embodiment of FIGS. 10-15, the device 100 resembles parts of a bicycle. This embodiment is like the device shown in U.S. Pat. No. 5,088,944 to Kats, which is incorporated herein by reference in its entirety. So much of what has not been explained specifically herein is explained in this Kats patent.

One main difference between the Kats device and the instant invention is that the entire device is moveable up and down with respect to the pontoons 111 for the same basic reasons stated above with respect to the other embodiments of FIGS. 1-9. Pedaling of pedal assembly 117 will turn gear 116 which turns gear 118, which turns shaft 131 and propeller 132 to cause the apparatus 100 to move forwardly as in the case of the Kats device mentioned above. Turning handlebar 165 turns rod 163 and rudder 161 to steer the device 100. It is to be understood that at least the parts that will sometimes extend under water are preferably made from non-corrosive materials, for example gears 116 and 118 can be made of nylon, as could many other of the parts shown in FIGS. 13-15.

A sub-frame including parts 126-126*f* slides up or down on the vertical part of frame 119, which will be explained in more detail below.

Figure 11:
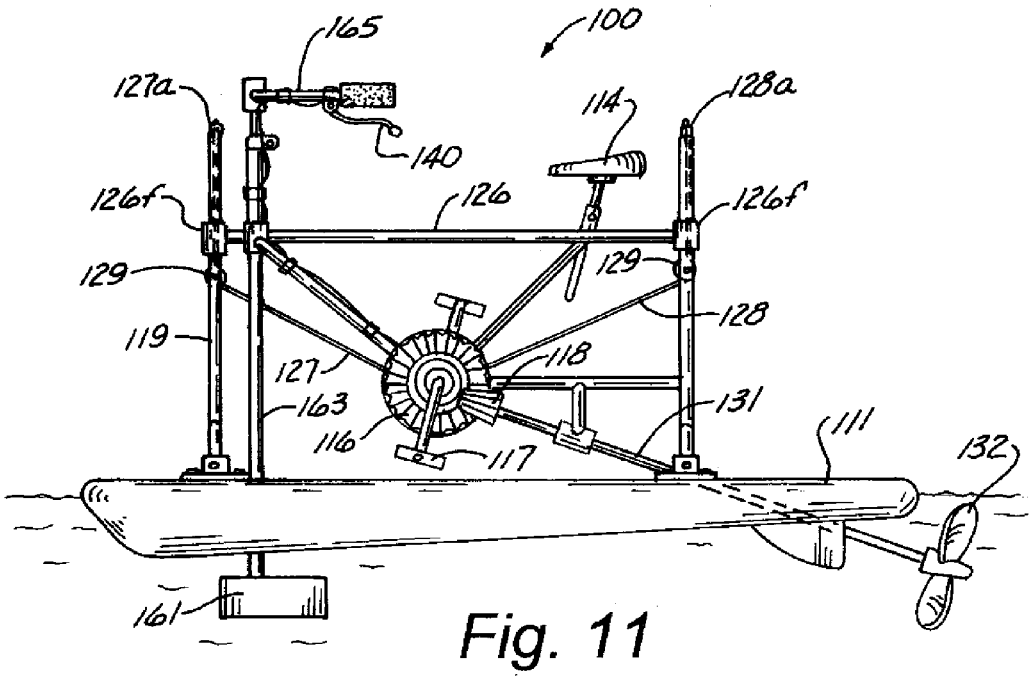
FIG. 11 is a view from one side of the embodiment of FIG. 10.
Figure 12:
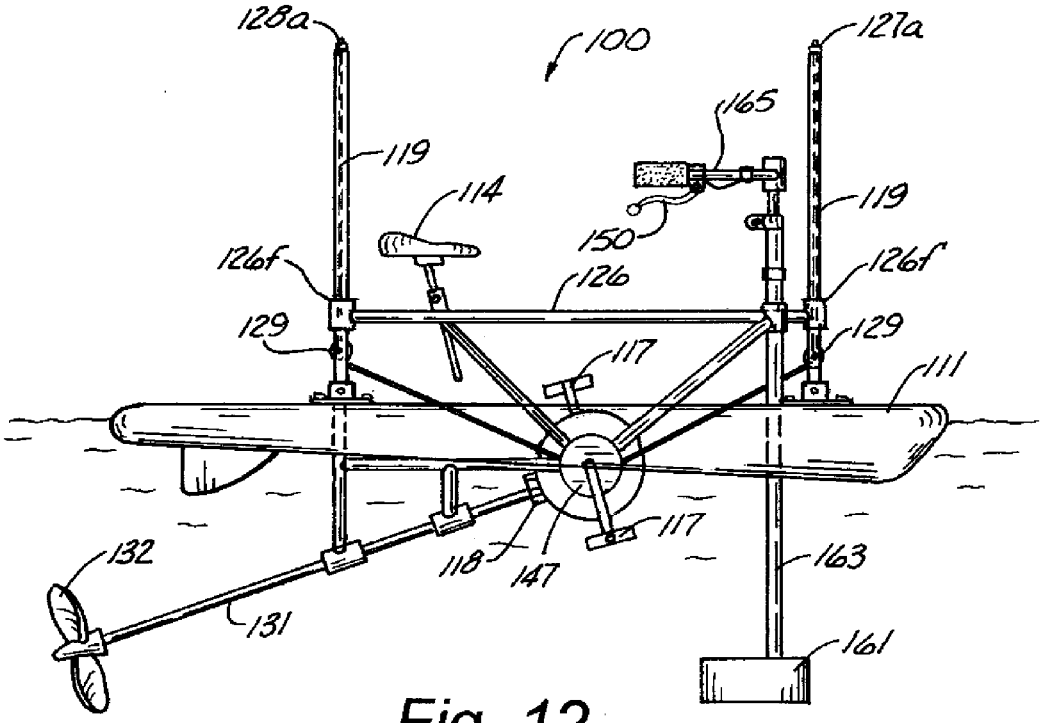
FIG. 12 is a view from the other side of the embodiment of FIG. 10 from the side shown in FIG. 11.
Figure 13:
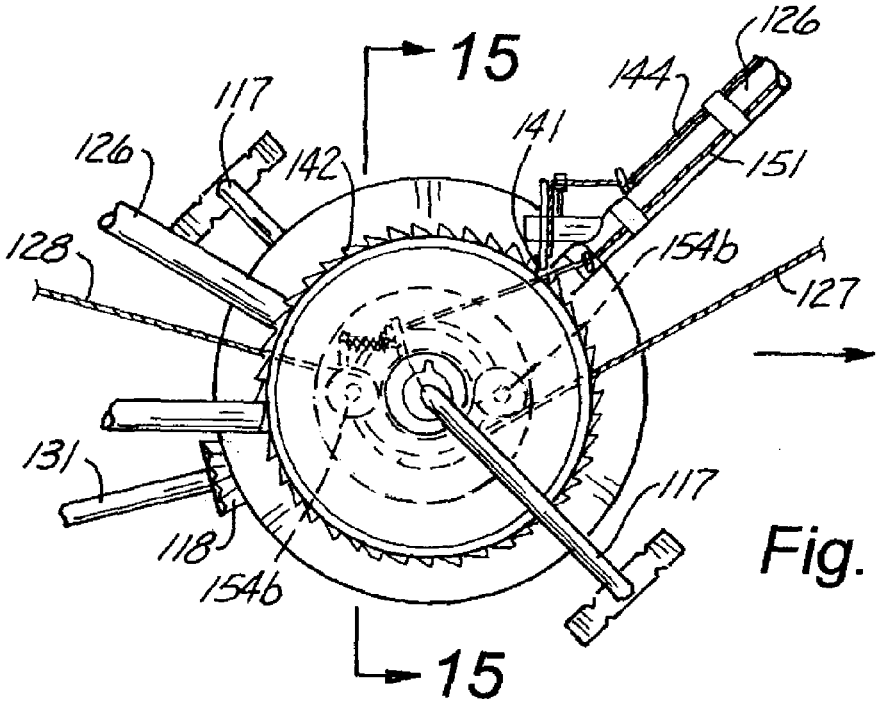
FIG. 13 is a partially broken away enlarged side view from the side shown in FIG. 12 showing a winch and clutch.
Figure 14:
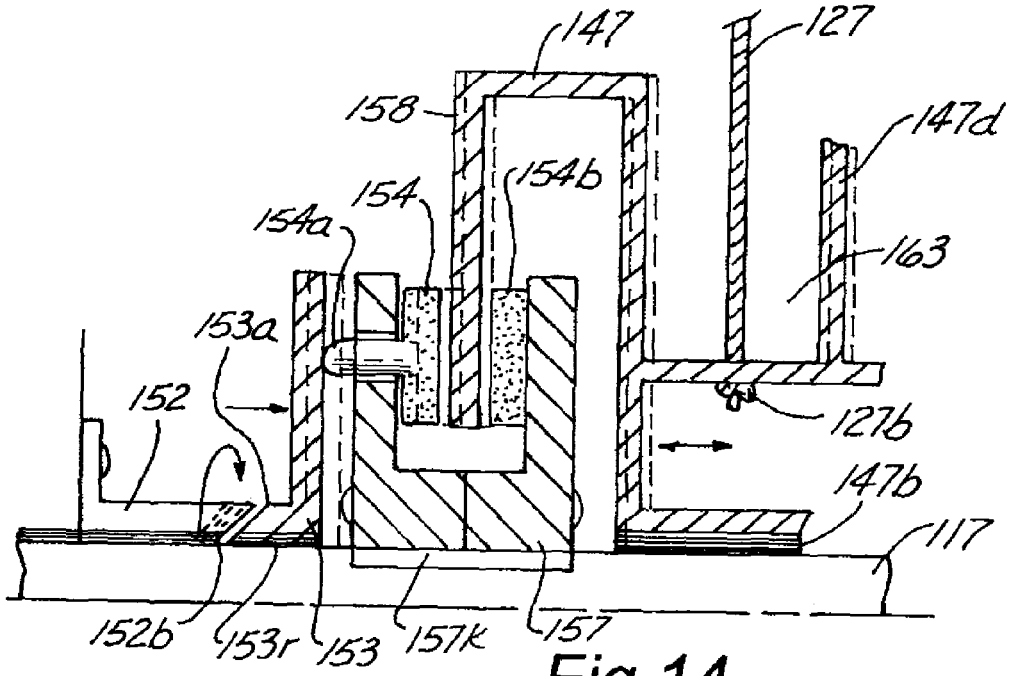
FIG. 14 is an enlarged cross sectional view like FIG. 15 showing a disc brake structure that operates as a clutch.

In operation of the embodiment of FIGS. 10-14, it would initially be in the configuration of FIG. 11, a raised position. In that position the propeller 132 is vertically up towards the top of the water ready to enter the water, say on a beach or the like. So an operator would walk it out into the water a little way, get on it like one would get onto a bicycle and start pedaling and steering it towards deeper water. As long as the goal is to get around the water as fast as possible using the pedals 117 then the configuration is maintained in a fashion similar to the way the Kats device would be used.

Assuming now that the user desires to use the apparatus 100 as an exercise device, the user would squeeze the left lever 140. This causes a pall 141, pivotally attached to the frame 126, to pivot upwardly to the dashed line position shown in FIG. 15. This will allow a gear 142 to be released, permitting the pedals to turn with winch housing 147 and the weight of the user will cause the entire frame 126, 126*a*, 126*b*, 126*c*, 126*d*, 126*e* and 126*f* to start down to the lowered position shown in FIG. 12. The user can impede such rotation of the pedals 117 by keeping the user's feet on the pedals 117 to control the speed of downward movement of the frame 126. If the lever 140 is released at any time while the frame 126 is moving downwardly, the pall 141 will move down to the solid line position shown in FIG. 15 to cause the rotation of gear 142 and winch housing 147 to stop rotating. Accordingly any vertical position can be selected on the way from the upper position of FIG. 11 to the lower position shown in FIG. 12. It is also to be understood that the device 100 could be made such that the frame 126 could extend much farther down into the water, perhaps even to the point where the seat 114 is under water, but this has not been shown in the preferred embodiment of FIGS. 10-15. The pall 141 is biased to the solid line position shown in FIGS. 13 and 15 by spring 143. So it can be seen that the gear 142 and winch housing 147 can only rotate to lower the device 100 when the handle 140 pulls cable 144 to pull up the pall 141.

Figure 15:
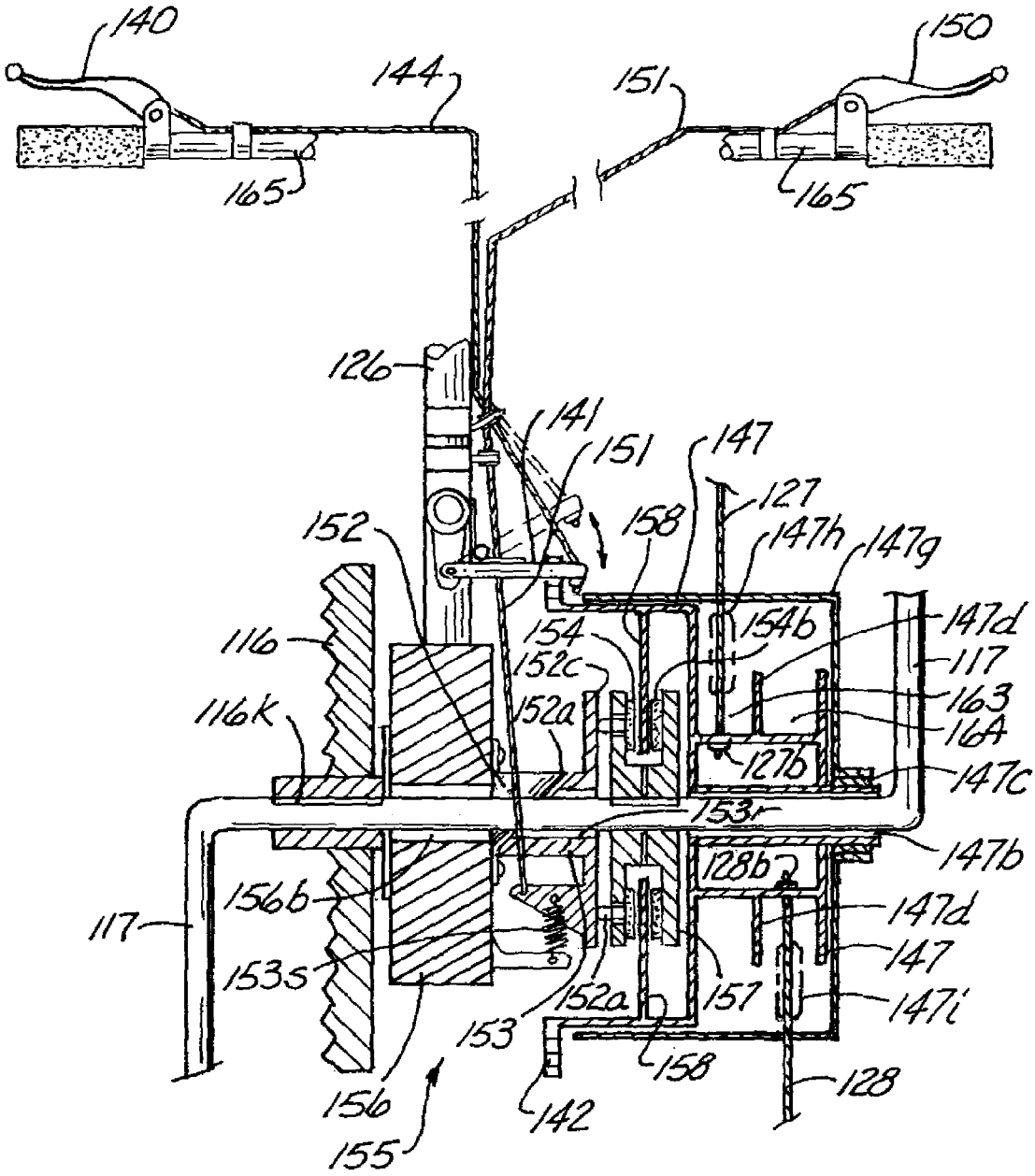
FIG. 15 is a cross sectional view taken along line 15-15 of FIG. 13.

Now assume that the user wants to return to the fastest mode of device 100 possible to get somewhere, perhaps back to the beach mentioned above, then the user would squeeze the right handle lever 150, which pulls cable 151, which rotates cam member 152, which in turn rotates member 152, which causes surfaces 152*a* and 153*a* to push member 153 to the right as shown in FIG. 15, thereby moving members 154 and 154*a* to the right as shown in dashed lines in FIG. 15. This causes brake pads 154 and 154*b* to contact the inner circumference of annular member 158, which is rigidly attached to cylindrical winch housing 147 as shown in dashed lines in FIG. 15. Note in dashed lines that the winch housing 147 will move to the right during such action as well, but only a short distance. This action will cause the winch housing 147 to rotate with the member 157, thereby causing the lines 127 and 128 to wind onto the winch housing 147, line 127 being on the left side of divider member 147*d* and the line 128 winding up on the right side of divider member 147*d*. This clutch structure 155 that is shown is just one possible clutch of many types that can be used, for example it could be just like a normal braking system on an automobile, for example. This braking action of brake pads 154 and 154*b* against the member 158 causes the structure just discussed to work like a clutch. So then, when brake pads 154 and 154*b* are held against the annular member 158, the winch assembly 147 rotates with pedal assembly 117. Member 156 is rigidly attached to the frame 126. Gear 116 is attached to the pedal assembly 117 by key 116*k* so that the gear 116 always rotates with the pedals 117. Similarly, member 157 is attached to pedal assembly 117 by key 157*k* so that member 157 always rotates with pedal assembly 157.

Bearing 156*b* allows pedal assembly 117 to rotate inside of member 156. Similarly a bearing 147*b* allows the pedal assembly 117 to rotate within winch housing 147 during normal operation of the device 100 when the winch is not being used to raise the frame 126. Once the clutch 155 is engaged as just explained above, rotation of pedals 117 will cause rotation of the winch housing 147. Such rotation of the winch housing 147 will cause cables or ropes 128 to wind up on spool portions 163 and 164 of winch housing 147. Continued pedaling will cause the winching of the device 100 from the FIG. 12 position to the FIG. 11 position, or to any desired position between those two vertical positions.

A guard 147*g* is disposed around the winch housing 147 and is mounted thereon by bearing 147*c*. In this way the winch housing 147 can rotate when it is desired to be rotated and can remain stationary when the winch 147 is not being used to raise or lower the frame 126. There are openings or holes 147*h* and 147*i* in the guard 147*g* that ropes or cables 127 and 128 extend through.

When the handle 150 is not being used, spring 153*s* biases the cam member 153 to the position shown in FIG. 15, which allows the winch housing 147 to not rotate with the member 157 and gear 116. Bearing 153*b* allows cam member 153 to rotate with respect to the pedal assembly 117 and vice versa. Cooperating stationary cam member 152 is rigidly attached to member 156 and a bearing 153*r* allows the pedal assembly 117 to rotate within member 152.

It is noted that the propeller 118 in the preferred embodiment will rotate anytime pedals 117 are rotated because the pedals 117 are rigidly attached to the gear 116. However the only time the winch housing 147 is rotated is when the clutch 155 is engaged by squeezing handle 150 and the pedals 117 are rotated. Other arrangements of course will still fall within the scope of the instant invention. The pall 141 allows the pedals to rotate in one forward direction at any time to turn propeller 118 without allowing reversing of the winch housing 147, which keeps the device 100 at the vertical level desired except when the user specifically wants to raise the frame 126 to the FIG. 11 position (using handle 150 and pedals 117) or lower it to the FIG. 12 position by using handle 140 and using the pedals 117 with the legs of the user to control how fast the sub-frame 126 lowers.

Obviously many modifications and variations of the present invention are possible in light of the above teachings. It is therefore to be understood that, within the scope of the appended claims, the invention may be practiced otherwise than as specifically described.

The invention claimed is:

1. A watercraft for transportation and exercise comprising:

a boat for floating on water and having a portion thereof above a waterline and a portion thereof below the waterline;

an opening in the boat for permitting a person to be partially below the waterline and partially above the waterline;

a sub-frame operatively attached to the boat, the sub-frame having a lower position and an upper position; and a propulsion device operatively attached to the sub-frame for propelling the watercraft forwardly in response to movement of the person's feet, the propulsion device having a foot contact portion, wherein:

the foot contact portion of the propulsion device is disposable a predetermined distance from the waterline for use in a transportation mode so that a person can be at least partially above the waterline when using the propulsion device in the transportation mode, said foot contact portion of the propulsion device being disposable in the water a distance below said predetermined distance when the propulsion device is being used in an exercise mode wherein at such time the person's legs are at least partially disposed below the waterline.

2. A watercraft according to claim 1, including means for adjustably moving the propulsion device vertically between the transportation and exercise modes thereof.

3. A watercraft according to claim 2, wherein a seat is operatively attached to the propulsion device whereby the seat moves vertically when the position of the propulsion device is adjusted.

4. A watercraft according to claim 3, including a steering device operatively attached to the boat for controlling the direction of left or right forward movement of the watercraft.

5. A watercraft according to claim 4, wherein the steering device includes a rudder.

6. A watercraft according to claim 1, wherein the propulsion device comprises:

a first elongated member operatively pivotally attached to the boat, below the waterline in use of the watercraft, said first elongated member having a first fin disposed toward a rear portion thereof; and a second elongated member operatively pivotally attached to the boat, below the waterline in use of the watercraft, said second elongated member having a second fin disposed toward a rear portion thereof, wherein:

a front portion of each of the first and second elongated members is disposed adjacent the person's feet in use of the watercraft, whereby the person can cause the first and second elongated members to selectively pivot up or down.

7. A watercraft according to claim 6, wherein the front portions of the first and second elongated members are operatively attached to a flexible member; and a pulley is operatively attached above the front ends of the elongated members to the boat whereby an intermediate portion of the flexible member is disposed above and is thereby held up by the pulley, whereby pushing downwardly on a front portion of one of the first and second elongated members creates an upward force on a front portion of the other one of the first and second elongated members.

8. A watercraft according to claim 7, comprising a first device operatively attached to the front portion of the first elongated member for receiving one of the person's feet; and a second device operatively attached to the front portion of the second elongated member for receiving the other one of the person's feet, whereby an up and down pumping motion by the person will cause simultaneous and opposite pivoting of the first and second elongated members thereby causing the fins on the rear of the first and second elongated members to propel the watercraft forwardly.

9. A watercraft according to claim 1, including means for locking the propulsion device in either the transportation or exercise mode thereof.

10. A watercraft according to claim 9, wherein the propulsion device has a plurality of vertical positions between the transportation and exercise modes thereof and the locking means can be used in any of such positions.

11. A watercraft according to claim 1, including a sailing mast operatively attached to a brace member.

12. A watercraft according to claim 11, wherein the sailing mast includes means for moving it between an out of the way position when it is not in use and another vertically disposed operative position thereof.

13. A watercraft according to claim 1, wherein the foot contact portion comprises pedals operatively rotatably attached to the sub-frame.

14. A watercraft according to claim 13, including a means for raising and lowering the sub-frame between the lower position and the upper position.

15. A watercraft according to claim 14, including a clutch operatively attached to the pedals and to the sub-frame for selectively actuating the raising and lowering means.

16. A watercraft according to claim 15, wherein the raising and lowering means is a winch selectively operated by the pedals.

17. A watercraft according to claim 16, including a ratchet gear operatively attached to the winch and a pall operatively attached to the sub-frame and spring biased to one position against the ratchet gear for permitting rotation of the winch in one direction without intervention and permitting rotation of the winch in an opposite direction when the pall is moved to a second position thereof.

* * * * *